US010224613B2

(12) United States Patent
Wu et al.

(10) Patent No.: US 10,224,613 B2
(45) **Date of Patent: *Mar. 5, 2019**

(54) WIRELESS DEVICE

(71) Applicant: MEDIATEK INC., Hsin-Chu (TW)

(72) Inventors: Min-Chung Wu, Hsinchu (TW); Shao-Chin Lo, Hsinchu (TW)

(73) Assignee: MEDIATEK INC., Hsin-Chu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/984,531

(22) Filed: May 21, 2018

(65) Prior Publication Data

US 2018/0269562 A1 Sep. 20, 2018

Related U.S. Application Data

(60) Continuation-in-part of application No. 15/202,587, filed on Jul. 6, 2016, now Pat. No. 9,979,073, which is a division of application No. 12/959,373, filed on Dec. 3, 2010, now abandoned.

(60) Provisional application No. 61/290,177, filed on Dec. 25, 2009.

(51) Int. Cl.

| | |
|---|---|
| ***H01Q 1/24*** | (2006.01) |
| ***H01Q 1/48*** | (2006.01) |
| ***H01Q 1/38*** | (2006.01) |
| ***H01Q 9/40*** | (2006.01) |

(52) U.S. Cl.

CPC ..... *H01Q 1/243* (2013.01); *H01Q 1/38* (2013.01); *H01Q 1/48* (2013.01); *H01Q 9/40* (2013.01)

(58) Field of Classification Search

CPC ..... H01Q 1/48; H01Q 1/38; H01Q 1/243; H01Q 9/40

See application file for complete search history.

(56) References Cited

U.S. PATENT DOCUMENTS

| | | | | |
|---|---|---|---|---|
| 5,608,610 | A * | 3/1997 | Brzezinski | H01L 23/3675 257/713 |
| 5,936,593 | A | 8/1999 | Mandai | |
| 6,265,771 | B1 * | 7/2001 | Ference | H01L 23/3677 257/676 |
| 7,969,365 | B2 | 6/2011 | Asraff | |
| 8,284,106 | B2 | 10/2012 | Guan | |
| 2003/0080904 | A1 | 5/2003 | Chen | |
| 2005/0128145 | A1 | 6/2005 | Hilgers | |
| 2005/0184376 | A1 * | 8/2005 | Salmon | H01L 22/22 257/686 |

(Continued)

FOREIGN PATENT DOCUMENTS

| | | |
|---|---|---|
| TW | 200726340 | 7/2007 |
| TW | 200926519 | 6/2009 |
| TW | M367429 | 10/2009 |

*Primary Examiner* — Hoang Nguyen
*Assistant Examiner* — Jae Kim
(74) *Attorney, Agent, or Firm* — McClure, Qualey & Rodack, LLP

(57) ABSTRACT

The present invention discloses a wireless device, which includes a substrate and an antenna. The antenna includes a printed antenna element and a 3-dimensional antenna element. The printed antenna element is printed on the substrate, while the 3-dimensional antenna element is disposed on the substrate and coupled to the printed antenna element. The printed antenna element and the 3-dimensional antenna element jointly have a physical length of a desired frequency.

9 Claims, 6 Drawing Sheets

(56) References Cited

U.S. PATENT DOCUMENTS

| | | | | |
|---|---|---|---|---|
| 2006/0091528 | A1* | 5/2006 | Yang | H01L 23/16 257/706 |
| 2008/0266180 | A1 | 10/2008 | Wu | |
| 2010/0073240 | A1 | 3/2010 | Cheng | |
| 2010/0214174 | A1 | 8/2010 | Guan | |
| 2010/0270667 | A1* | 10/2010 | Tong | H01L 23/055 257/682 |
| 2011/0068996 | A1 | 3/2011 | Flores-Cuadras | |

* cited by examiner

WIRELESS DEVICE

CROSS REFERENCE TO RELATED APPLICATIONS

This application is a Continuation-In-Part application of U.S. application Ser. No. 15/202,587, which is a divisional application of U.S. application Ser. No. 12/959,373 filed on Dec. 3, 2010, which claims the benefit of U.S. Provisional Application No. 61/290,177, filed on Dec. 25, 2009 and entitled "WIRELESS DEVICE", the contents of which are incorporated herein by reference.

BACKGROUND OF THE INVENTION

1. Field of the Invention

The present invention relates to a wireless device, and more particularly, to a removable wireless device with a compact antenna design and improved thermal dissipation characteristic.

2. Description of the Prior Art

A removable wireless device, such as USB (Universal Serial Bus) device, is useful to expand or upgrade portable equipment with functionality that the portable equipment does not have. For example, a Wi-Fi USB dongle can help a notebook access to wireless local area network (WLAN); while a BT (Bluetooth) USB dongle can help the notebook connect with other peripheral devices. In another example, if the notebook is originally equipped with a legacy WLAN device, such as those compatible with IEEE802.11a/b/g, using an IEEE 802.11n USB dongle can easily upgrade the wireless connection capability of the notebook.

However, the removable wireless device often extrudes from the portable equipment and interferes with the user when using the portable equipment. A common method to reduce the size of the removable wireless device is to change the design of the antenna. FIG. 1 to FIG. 3 illustrates different type of antennas used in a WLAN USB dongle. The antenna 102 in FIG. 1 is a printed antenna laid on the substrate 103 and coupled to the ground plane 101. The printed antenna 102 has to be thin and meandered so as to achieve a required physical length such as quarter wavelength of a desired frequency band, for example. However, this high density layout may cause large impedance and make time-variable currents thereon be eliminated with each other. Besides, the large area that the printed antenna occupies is another concern.

The antenna 202 in FIG. 2 is a metal folded 3-dimensional antenna set up on the substrate 203. The disadvantage of the antenna 202 is that precision of manufacturing such kind of antenna is low. Using this kind of antenna also increases the size of the wireless device since the antenna has to be expanded in the three dimensional space to reach the desired physical length.

FIG. 3 illustrates a conventional chip antenna 302. The chip antenna 302 is disposed on the substrate 303, and coupled to the ground plane 301. The chip antenna 302 reduces the size of the antenna, but increases the cost of the antenna and has low antenna efficiency and low peak gain in a small ground plane.

Therefore, it is still difficult for those skilled in the art to have an antenna design with high efficiency, compact size and low cost in a removable wireless device.

In addition, when the size of the wireless device is reduced, there's less area to dissipate heat. Moreover, a dense arrangement of the chips and components also increase the amount of heat generated inside the wireless device. Therefore, there's also a need to provide a compact wireless device with an improved thermal dissipation characteristic.

SUMMARY OF THE INVENTION

It is therefore an objective of the claimed invention to provide a compact wireless device with improved thermal dissipation characteristic.

The present invention discloses a wireless device, which includes a substrate, a first chip, a second chip and a housing. The substrate comprises a first side and a second side opposite to the first side. The first chip is disposed on the first side of the substrate. The second chip is disposed on the second side of the substrate. The housing encapsulates the substrate, the first chip and the second chip, and is thermally coupled to the first chip, and is utilized for dissipating heat of the first chip, wherein the first chip is in direct contact with the housing and the housing is made by a metal, and wherein the housing further has an opening, and the opening facilitates to dissipate heat of the first chip and heat of the second chip to the outside of the wireless device by heat convection.

The present invention further discloses a wireless device, which includes a substrate, a first chip, and a housing. The substrate comprises a first side and a second side opposite to the first side. The first chip is disposed on the first side of the substrate. The housing accommodates the substrate and the first chip, and is thermally coupled to the first chip, for dissipating heat of the first chip, wherein portions of the housing are on the first side and the second side of the substrate, and wherein the first chip is in direct contact with the housing and the housing is made by a metal, and wherein the housing further has an opening, and the opening facilitates to dissipate heat of the first chip to the outside of the wireless device by heat convection.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
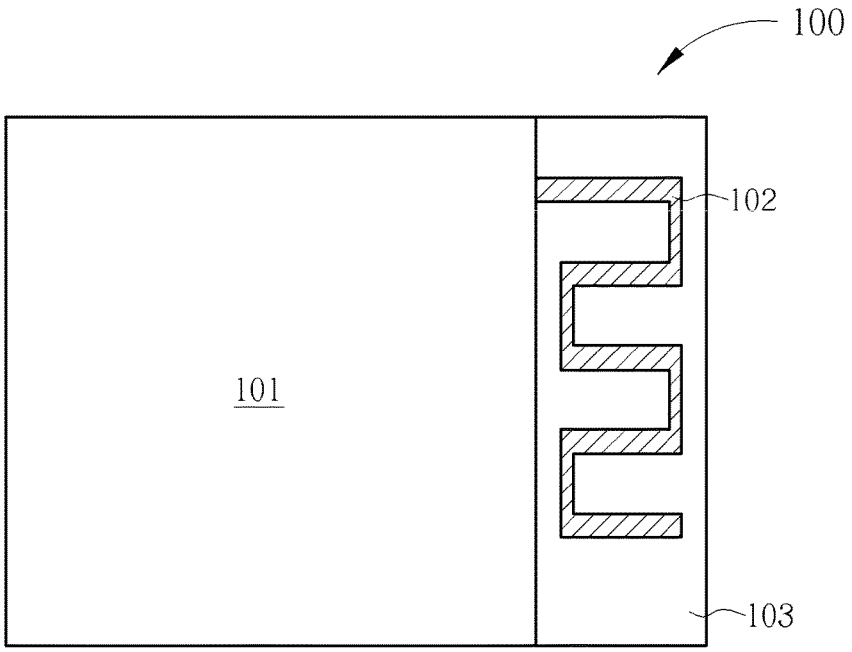
FIG. 1 PRIOR ART
FIG. 1 illustrates a conventional antenna design in a removable wireless device.
Figure 2:
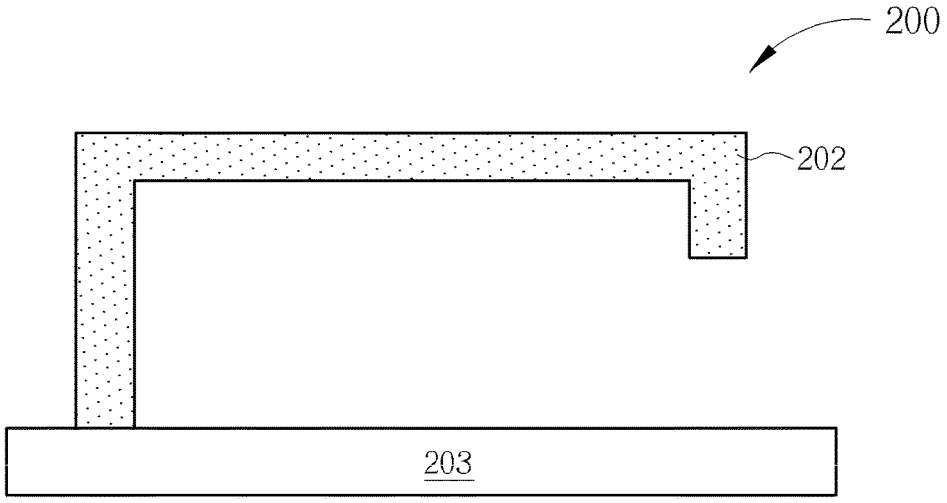
FIG. 2 PRIOR ART
FIG. 2 illustrates another conventional antenna design in a removable wireless device.
Figure 3:
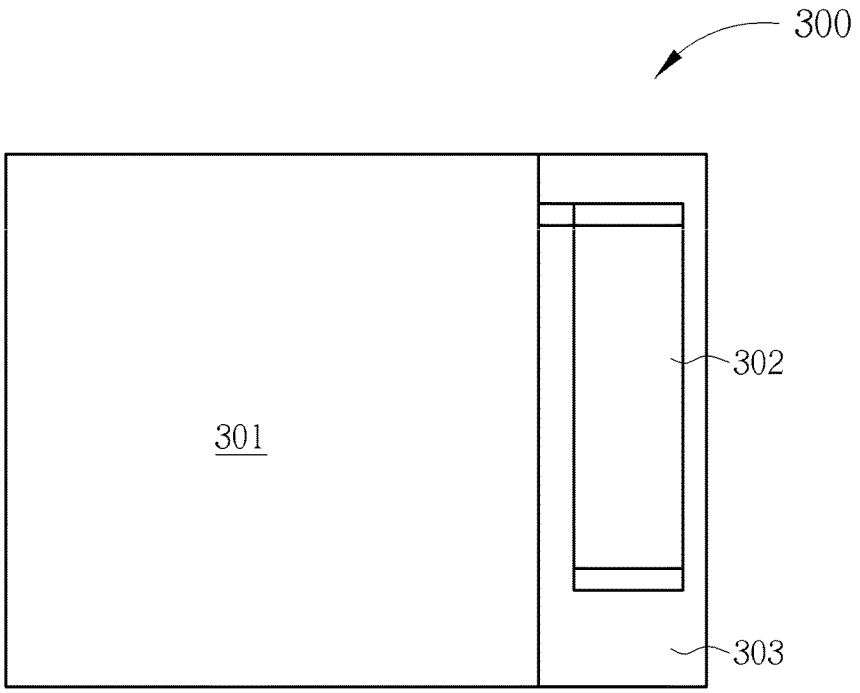
FIG. 3 PRIOR ART
FIG. 3 illustrates yet another conventional antenna design in a removable wireless device.
Figure 4:
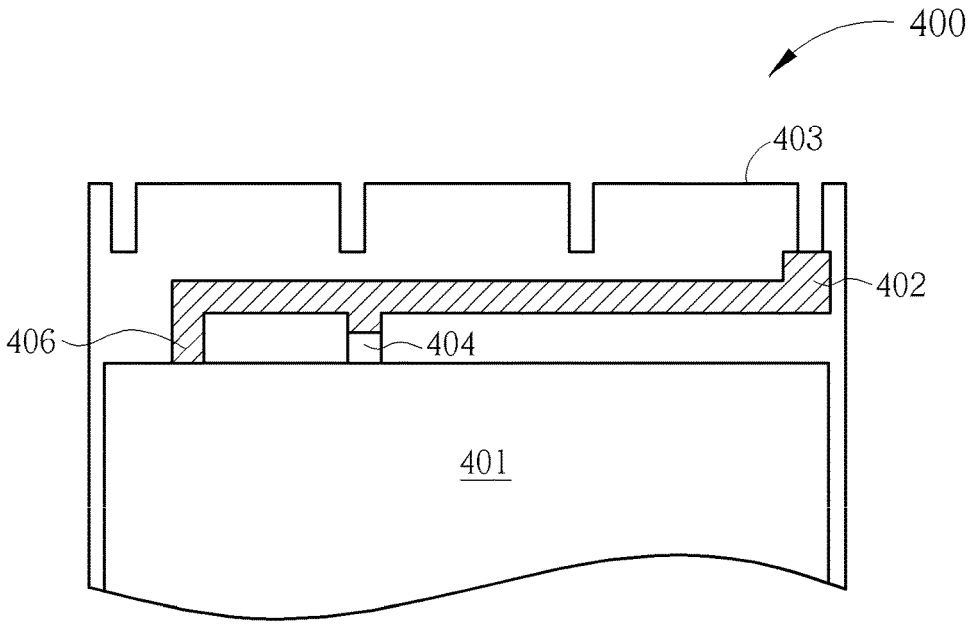
FIG. 4 illustrates a top view of an antenna according to an embodiment of the present invention.
Figure 5:
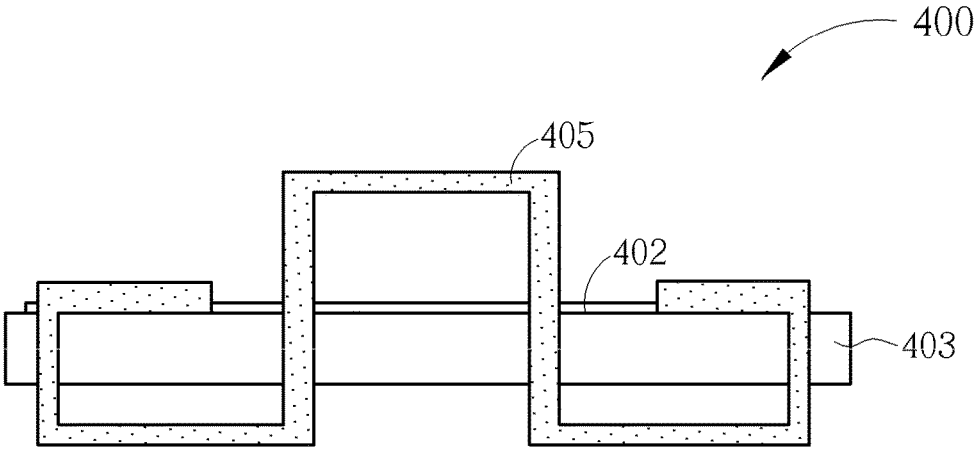
FIG. 5 illustrates a front view of an antenna according to an embodiment of the present invention.
Figure 6:
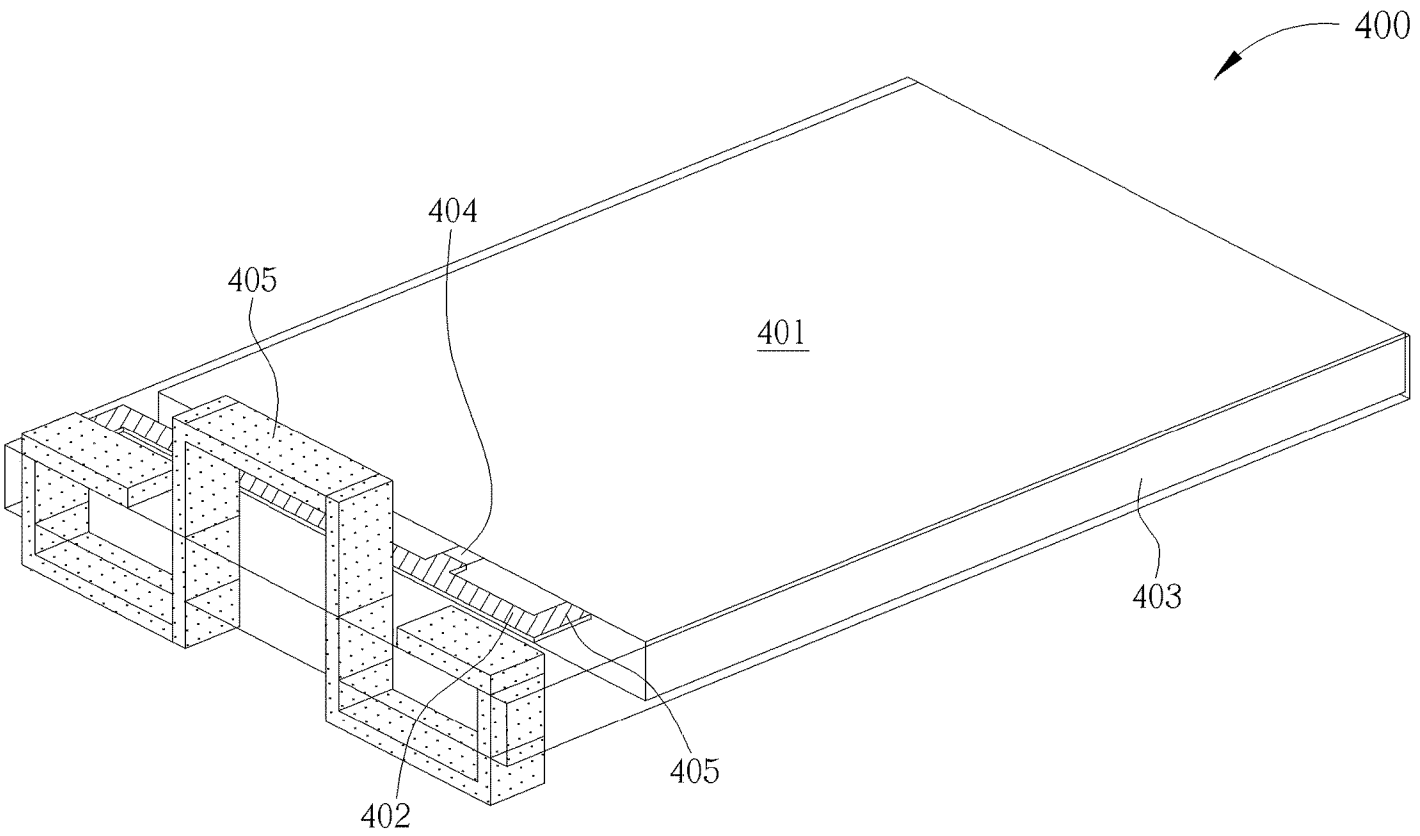
FIG. 6 illustrates a whole antenna structure in a removable wireless device according to an embodiment of the present invention.

Antenna Design:

Please refer to FIG. 4 to FIG. 6, which illustrates a wireless device 400 according to an embodiment of the present invention. The wireless device 400 includes a substrate 403, a printed antenna element 402 shown in FIG. 4, and a 3-dimensional antenna element 405 shown in FIG. 5. The printed antenna element 402 is printed on the substrate 403, while the 3-dimensional antenna element 405 is set up on the substrate 403 with an end coupled to the printed antenna element 402. The printed antenna element 402 and the 3-dimensional antenna element 405 constitute an antenna of the wireless device 400, and jointly have a physical length of a desired frequency band such as 2.4 GHZ of IEEE 802.11n, for example.

In addition, the antenna of the wireless device 400 further includes a ground plane 401, a short port 406 and a feed-in port 404. The ground plane 401 is formed in a layer of the substrate 403. The feed-in port 404 and the short port 406 are also printed on the substrate 403. The short port 406 couples the printed antenna element 402 with the ground plane 401. The feed-in port 404 and the short port 406 are both located on one side of the substrate 403. Thus, the printed antenna element 402 can extend from one side of the substrate 403 to the other side of the substrate 403. Take FIG. 4 for example, the printed antenna element 402 extends from the left side of the substrate 403 to the right side of the substrate 403. However, the printed antenna element 402 can extend to any direction and is not limited to the embodiment shown in FIG. 4. Since the printed antenna element 402 is a straight trace, there's no reverse time-variable current in this surface to reduce the radiated magnetic field. But the size of the printed antenna element 402 is limited to the size of the substrate 403 and can not reach the physical length of optimum radiation in 2.4 GHz.

Therefore, the 3-dimensional antenna 405 shown in FIG. 5 is coupled to the printed antenna 402 to increase the physical length. By using the substrate surface and the 3-dimensional space inside the housing (not shown) of the wireless device 400, the printed antenna element 402 and the 3-dimensional antenna element 405 can jointly reach the optimum length of the desired frequency band. If the length is not enough, a meander design as shown in FIG. 5 can be used to reach the desired length. Besides, since the 3-dimensional antenna 405 is substantially perpendicular to the printed antenna 402, the vertical current in the antenna 405 would not eliminate the horizontal current in the printed antenna 402. Therefore, a better radiation efficiency and gain can be achieved. The whole antenna structure of the wireless device 400 can be seen in FIG. 6.

It is worth noting that this antenna design can be implemented in any compact wireless device, such a Wi-Fi USB dongle or a Bluetooth (BT) USB dongle, for example, and that modifications made by those skilled in the art according to practical requirements still belong to the scope of the present invention, as long as the trace and the sheet metals are used to make up the antenna of the wireless device.

Figure 7:
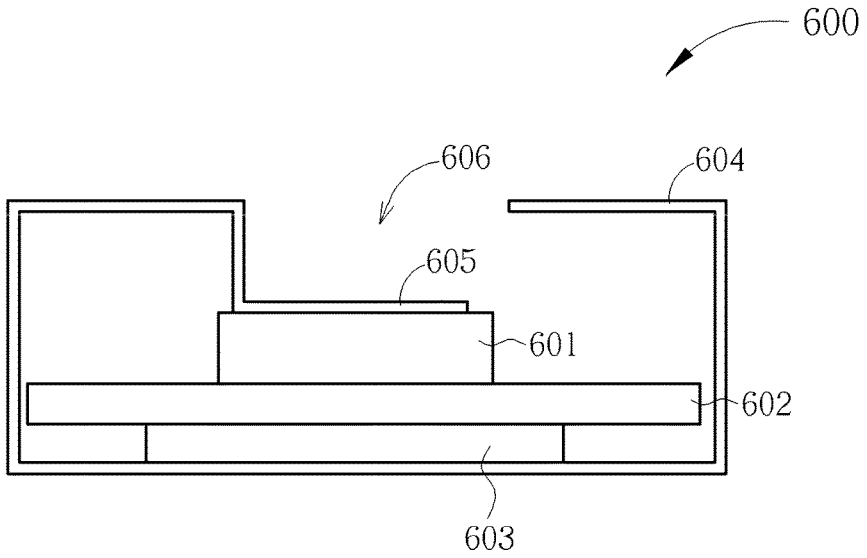
FIG. 7 illustrates a wireless device according to another embodiment of the present invention.

Heat Dissipation:

Regarding the heat dissipation issue, the present invention provides a wireless device 600 with a structure shown in FIG. 7 to solve the problem. As shown in FIG. 7, the wireless device 600 includes a substrate 602, a housing 604 and chips 601 and 603. The chips 601 and 603, configured on each side of the substrate 602, are for illustration only. The number of chips on the substrate 602 can be any number, and is not limited to these. The housing 604 is utilized for encapsulating the substrate 602 and the chips 601, 603. Since the chips 601 and 603 are main heating elements of the wireless device 600, such as a low dropout liner regulator (LDO) or the main baseband/MAC IC, and the housing 604 is usually manufactured by a conductive material, such as metal, the housing 604 is configured to thermally couple to the chips 601 and 603, so that the housing 604 can help dissipating heat generated by the chips 601 and 603 by heat conduction.

Besides, since the chips 601 and 603 are located at different sides of the substrate 602, the heat generated by these two chips can be dissipated from the top and bottom of the housing 604. Moreover, as shown in FIG. 7, the housing 604 can further include an opening 606 when configured to thermally couple to the chip 601, such that the opening 606 can also help dissipating the heat from the inside of the housing 604 to the outside by heat convection. Please note that, in another embodiment of the present invention, the housing does not have to be in direct contact with the chips, any thermal conductor can be placed between the chips and the housing for heat dissipation.

Therefore, by the chip arrangement and the housing design, the housing can help dissipate the heat generated by the main heating elements by the heat conduction and the heat convection, such that the operating temperature of the wireless device can be reduced.

Figure 8:
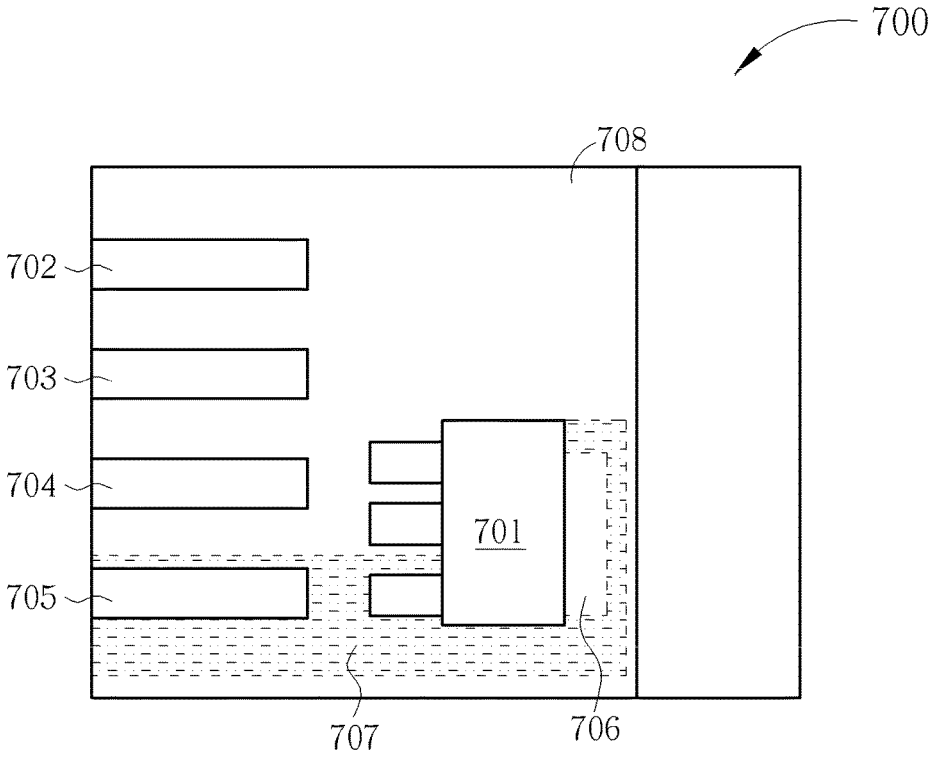
FIG. 8 illustrates a wireless device according to yet another embodiment of the present invention.

Please refer to FIG. 8, which illustrates a wireless device 700 according to another embodiment of the present invention. As shown in FIG. 8, the wireless device 700 includes a substrate 708, a chip 701 and connection pins 702, 703, 704 and 705. The chip 701 is a main heating element of the wireless device 700, such as a low dropout liner regulator (LDO) or the main baseband/MAC IC, and is configured on the top side of the substrate 708. The connection pins 702, 703, 704 and 705 are laid on the top side of the substrate 708, and are used to connect the wireless device 700 to portable equipment (not shown). The connection pins 702, 703, 704 and 705 can be arranged according to the USB standard, but are not limited thereto. Since the chip 701 has a pin 706 for receiving power while the connection pin 705 is used to provide voltage to drive the chip 701, the connection pin 705 is coupled to the pin 706 of the chip 701 on the same layer of the substrate 708.

Therefore, the heat generated by the chip 701 can be dissipated from the pin 706 to the pin 705 and then to the portable equipment when the wireless device is plugged into the portable equipment. Moreover, to make the heat conduction more efficiently, a wide power trace layout 707 can be used to connect the pin 705 and pin 706, so as to form a more efficient heat dissipation path.

By the heat dissipation method mentioned above, the present invention provides a compact wireless device, such as a Wi-Fi USB dongle, a BT USB dongle or a High Definition Multimedia Interface (HDMI) dongle, with improved thermal dissipation characteristic.

For example, high definition multimedia interface (HDMI) may be an all-digital video and audio transmission interface that can transmit uncompressed audio and video signals. HDMI can be used in set-top boxes, DVD players, personal computers, video games, integrated amplifiers, digital audio, or televisions. HDMI can transmit audio and video signals at the same time so that the installation of system lines can be reduced. The above is just an exemplary HDMI, and is not intended to limit the invention.

Figure 9:
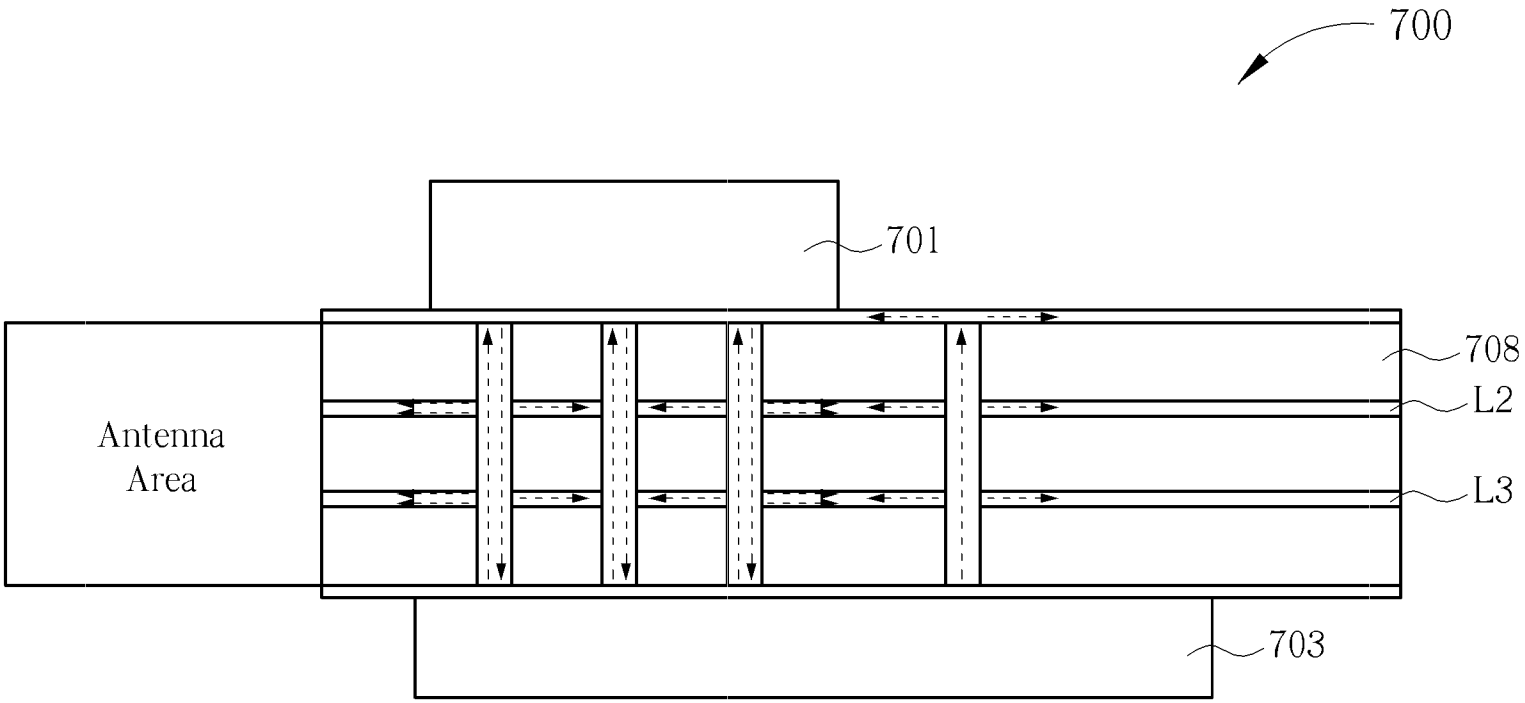
FIG. 9 illustrates a cross-section view of the wireless device in FIG. 8.

In addition, the present invention provides another method to dissipate the heat generated by the chips by arranging all the trace on the surface of the substrate. Please refer to FIG. 9, which shows a cross-section view of the wireless device 700. As shown in FIG. 9, the wireless device 700 further includes a chip 703, configured on the bottom side of the substrate 708. Since all traces and chips are arranged on both sides of the substrate 708, the substrate 708 can then have complete conductive layer acting as a ground plane of the wireless device inside the substrate 708, such as a second layer L2 and a third layer L3 of the substrate 708 shown in FIG. 9. Since the traces or the chips on the substrate 708 are coupled to the ground planes L2 and L3 though via holes, the heat generated by the chips can be conducted to the wide ground planes, so as to improve the heat dissipation.

Therefore, by appropriately designing the layout, the heat generated by the chips can be dissipated by the wide power trace layout and the complete conductive layers inside the substrate, such that the operating temperature of the compact size wireless device can be reduced.

Please note that the above-described embodiments of the present invention are intended to be illustrative only. Numerous alternative embodiments may be devised by persons skilled in the art without departing from the spirits and scope of the present invention. For example, in another embodiment of the present invention, combinations of the above heat dissipation methods can be made to achieve an optimum thermal dissipation characteristic of a compact wireless device.

In summary, by the antenna design and the heat dissipation methods mentioned above, the present invention provides the compact wireless device, such as a Wi-Fi USB dongle, a BT USB dongle or a HDMI dongle, with high antenna efficiency and improved thermal dissipation characteristic.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A wireless device, comprising:

a substrate, comprising a first side and a second side opposite to the first side;

a first chip, disposed on the first side of the substrate;

a second chip, disposed on the second side of the substrate; and a housing, encapsulating the substrate, the first chip and the second chip, thermally coupled to the first chip, for dissipating heat of the first chip;

wherein the first chip is in direct contact with the housing and the housing is made by a metal, and wherein the housing further has an opening, and the opening facilitates to dissipate heat of the first chip and heat of the second chip to the outside of the wireless device by heat convection.

2. The wireless device of claim 1, wherein the first chip is a heating element of the wireless device.

3. The wireless device of claim 1, wherein the second chip is a heating element of the wireless device.

4. The wireless device of claim 1, wherein the wireless device is a HDMI dongle.

5. The wireless device of claim 1, wherein the second chip is in direct contact with the housing.

6. A wireless device, comprising:

a substrate, comprising a first side and a second side opposite to the first side;

a first chip, disposed on the first side of the substrate; and a housing, accommodating the substrate and the first chip, and thermally coupled to the first chip, for dissipating heat of the first chip, wherein portions of the housing are on the first side and the second side of the substrate;

wherein the first chip is in direct contact with the housing and the housing is made by a metal, and wherein the housing further has an opening, and the opening facilitates to dissipate heat of the first chip to the outside of the wireless device by heat convection.

7. The wireless device of claim 6, further comprising:

a second chip, disposed on the second side of the substrate, having a surface thermally coupled to the housing.

8. The wireless device of claim 6, wherein the second chip is in direct contact with the housing.

9. The wireless device of claim 6, wherein the wireless device is a HDMI dongle.

* * * * *